US005264662A

United States Patent [19]

Kennedy

[11] Patent Number: 5,264,662

[45] Date of Patent: Nov. 23, 1993

[54] ELECTRICAL OUTLET COVER APPARATUS

[76] Inventor: Terry L. Kennedy, 1042 Jackson Ct., Milbrook Manor, Mt. Pleasant, Mich. 48858

[21] Appl. No.: 699,648

[22] Filed: May 14, 1991

[51] Int. Cl.[5] ..... H01R 13/44

[52] U.S. Cl. ..... 174/67; 439/147

[58] Field of Search ..... 174/67; 220/242; 439/135, 136, 142, 147

[56] References Cited

U.S. PATENT DOCUMENTS

| | | | |
|---|---|---|---|
| 2,722,665 | 11/1955 | Sauder | 174/67 X |
| 2,880,264 | 3/1959 | Ruskin | 174/67 |
| 2,916,733 | 12/1959 | Hirsch | 174/67 X |
| 3,067,402 | 12/1962 | Thaw | 174/67 X |
| 4,083,618 | 4/1978 | Busch, Jr. | 439/147 |
| 4,993,963 | 2/1991 | Pedigo | 220/242 X |
| 5,078,614 | 1/1992 | Shotey | 174/67 X |

FOREIGN PATENT DOCUMENTS

| | | | |
|---|---|---|---|
| 1243712 | 8/1971 | United Kingdom | 439/136 |

*Primary Examiner*—Leo P. Picard
*Assistant Examiner*—David Tone
*Attorney, Agent, or Firm*—Leon Gilden

[57] ABSTRACT

An apparatus including an outlet plate, with a perimeter flange coextensively arranged about the plate adjacent a perimeter edge of the plate, with the flange slidably and lockably receiving a housing, with the housing including an elongate slot directed through a forward wall thereof, with clip members mounted adjacent terminal ends of a continuous groove directed through side and top walls of the housing to secure the flange therewithin.

1 Claim, 4 Drawing Sheets

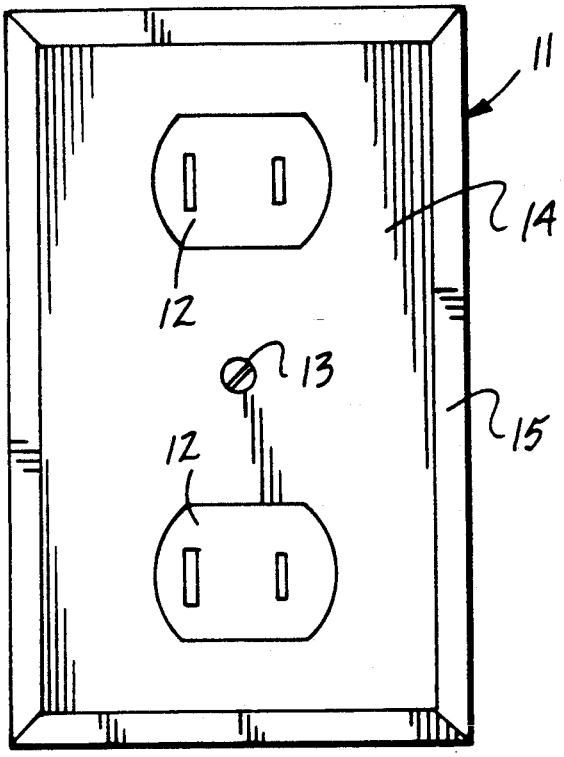
FIG 3
FIG 4
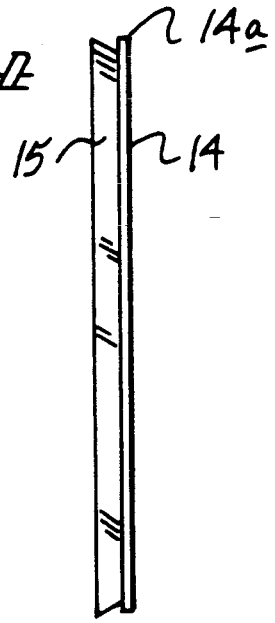

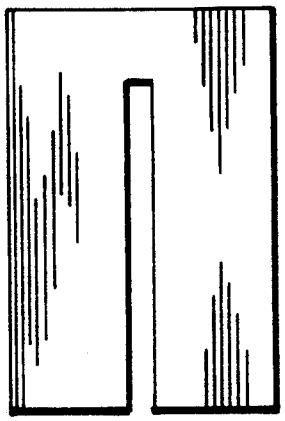
Fig 5
Fig 6
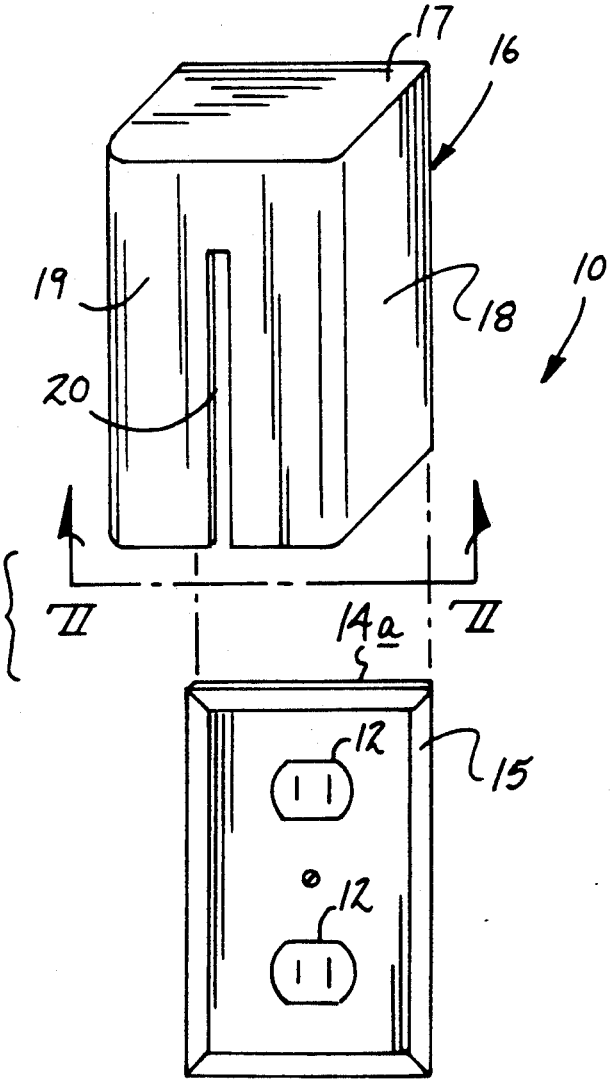

ELECTRICAL OUTLET COVER APPARATUS

BACKGROUND OF THE INVENTION

1. Field of the Invention

The field of invention relates to electrical cover apparatus, and more particularly pertains to a new and improved electrical outlet cover apparatus wherein the same permits ease of securement and mounting of a housing overlying an associated outlet cover plate.

2. Description of the Prior Art

Various cover plates and locks therefore have been utilized in the prior art to limit access to an outlet to maintain such organizations out of reach of children and the like. Examples of such prior art devices are found for examples in U.S. Pat. No. 4,586,765 to Ban wherein a safety cover is provided for an outlet utilizing a cover plate mounted to an inner plate that are uniquely hinged together by a single hinge secured to one of the plates.

U.S. Pat. No. 3,129,992 to Blonder sets forth an electrical connector locking system which prevents access to the outlet organization by use of a locking cover overlying the outlet portions of the outlet plate.

U.S. Pat. No. 4,603,931 to Ruffman sets forth a cover housing to overlie an electrical outlet, wherein outlet plugs are captured within the housing to prevent unauthorized removal of appliances associated with the outlet plugs.

U.S. Pat. No. 4,070,078 sets forth a safety cover that is hingedly mounted to an outlet that is lockably mounted relative to the outlet plate to prevent inadvertent access thereto.

U.S. Pat. No. 4,674,813 to Feldner sets forth an outlet cover housing utilizing a lock member to prevent unauthorized access to the outlet portion of the electrical outlet plate.

As such, it may be appreciated that there continues to be a need for a new and improved electrical outlet cover apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of electrical outlet covers now present in the prior art, the present invention provides an electrical outlet cover apparatus wherein the same provides a snap-fit securement of an electrical outlet housing relative to an electrical outlet cover plate. As such, the general purpose of the present invention, which will be described subsequently in greater detail, is to provide a new and improved electrical outlet cover apparatus which has all the advantages of the prior art electrical outlet cover apparatus and none of the disadvantages.

To attain this, the present invention provides an apparatus including an outlet plate, with a perimeter flange coextensively arranged about the plate adjacent a perimeter edge of the plate, with the flange slidably and lockably receiving a housing, with the housing including an elongate slot directed through a forward wall thereof, with clip members mounted adjacent terminal ends of a continuous groove directed through side and top walls of the housing to secure the flange therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical outlet cover apparatus which has all the advantages of the prior art electrical outlet cover apparatus and none of the disadvantages.

It is another object of the present invention to provide a new and improved electrical outlet cover apparatus which may be easily and efficiently manufactured and marketed.

It is a further object of the present invention to provide a new and improved electrical outlet cover apparatus which is of a durable and reliable construction.

An even further object of the present invention is to provide a new and improved electrical outlet cover apparatus which is susceptible of a low cost of manufacture with regard to both materials and labor, and which accordingly is then susceptible of low prices of sale to the consuming public, thereby making such electrical outlet cover apparatus economically available to the buying public.

Still yet another object of the present invention is to provide a new and improved electrical outlet cover apparatus which provides in the apparatuses and methods of the prior art some of the advantages thereof, while simultaneously overcoming some of the disadvantages normally associated therewith.

Still another object of the present invention is to provide a new and improved electrical outlet cover apparatus wherein the same is slidably and lockably mounted to overlie an associated and mating electrical outlet cover plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken in elevation, of the outlet cover plate of the instant invention.

FIG. 4 is an orthographic side view, taken in elevation, of the outlet cover plate as illustrated in FIG. 3.

FIG. 5 is an orthographic frontal view, taken in elevation, of the outlet cover housing utilized by the instant invention.

FIG. 6 is an isometric illustration of the organization in a disassembled configuration.

DESCRIPTION OF THE PREFERRED EMBODIMENT

Figure 1:
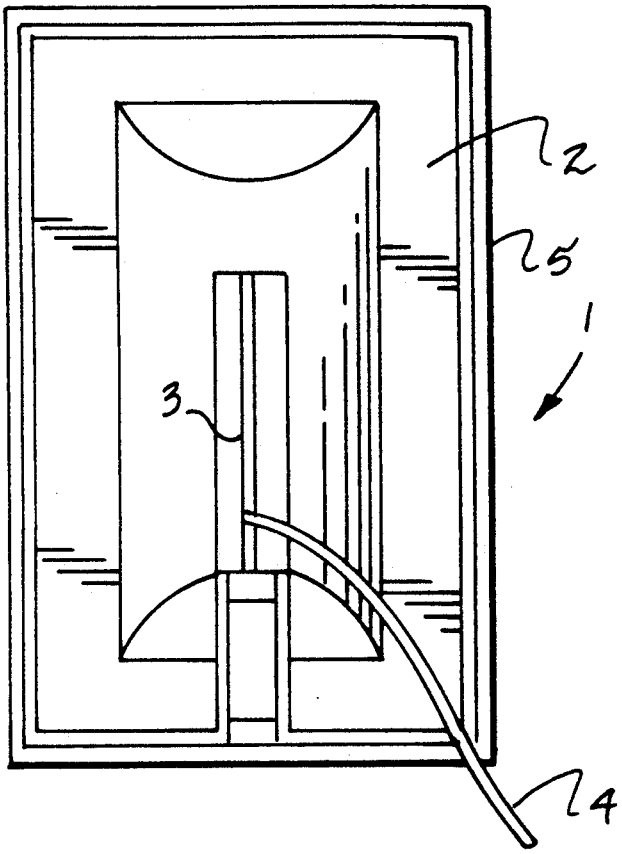
Fig 1 PRIOR ART
FIG. 1 is an orthographic view, taken in elevation, of a prior art electrical outlet cover apparatus.
Figure 2:
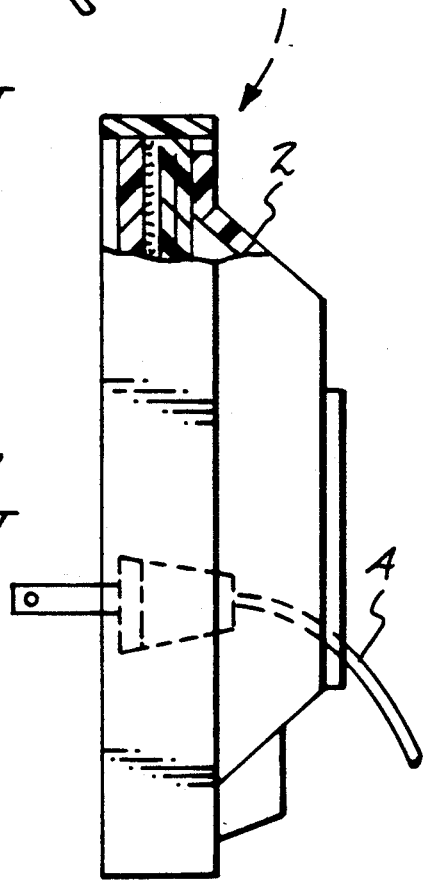
Fig 2 PRIOR ART
FIG. 2 is an orthographic view, partially in section, of a prior art outlet cover apparatus.

With reference now to the drawings, and in particular to FIGS. 1 to 8 thereof, a new and improved electrical outlet cover apparatus embodying the principles and concepts of the present invention and generally designated by the reference numeral 10 will be described.

FIG. 1 illustrates a prior art outlet cover apparatus 1, wherein the cover 2 utilizes a slot 3 to permit access of electrical cords 4 therethrough, with the housing mounted within the inner plate 5.

More specifically, the electrical outlet cover apparatus 10 of the instant invention essentially comprises an outlet plate 11 defined by a central mounting plate 14, with a central or medially positioned mounting screw 13, with a plurality of plug outlets 12 directed through the mounting plate 14 about the mounting screw 13 in a spaced relationship. A perimeter flange 15 is fixedly mounted to a forward surface of the mounting plate 14 whose base is mounted interiorly of the mounting plate 14 spaced from a perimeter edge 14*a* of the mounting plate. The mounting flange 15 is thereafter directed outwardly of the perimeter edge 14*a* to define a continuous ledge thereabout between the base of the mounting flange 15 and the perimeter edge 14*a*.

Figure 7:
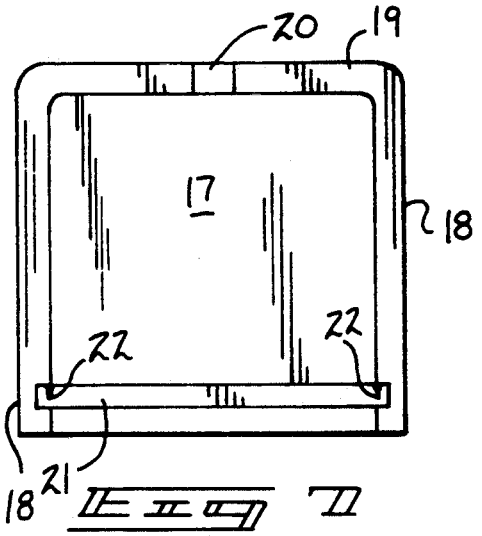
FIG. 7 is an orthographic bottom view of the cover housing of the instant invention.

FIGS. 5–7 illustrate the use of a cover housing 16, including a top wall 17, spaced side walls 18, and an opening directed through the bottom of the housing underlying the top wall 17. A forward wall 19 is fixedly mounted to the side and top walls, as illustrated, with a forward wall slot 20 originating at a bottom edge of the forward wall and directed upwardly therefrom to overlie the outlets 12 when the housing is mounted to the plate 11. A continuous groove 21 is formed within the side and top walls 18 and 17 respectively that is orthogonally directed interiorly of an interior surface of the side and top walls to receive the perimeter flange 15 therewithin, wherein the housing 16 is directed over the flange, as illustrated in FIG. 6 for example. Flexible clip members 22 are mounted to overlie the groove 21 and are aligned with the bottom edge of the side walls 18, as illustrated in FIG. 7, to secure the flange 15 within the groove 21. Further it should be noted that the portions of the groove 21 directed within the side walls 18 are of a height substantially equal to a predetermined length defined by the flange 15.

Figure 8:
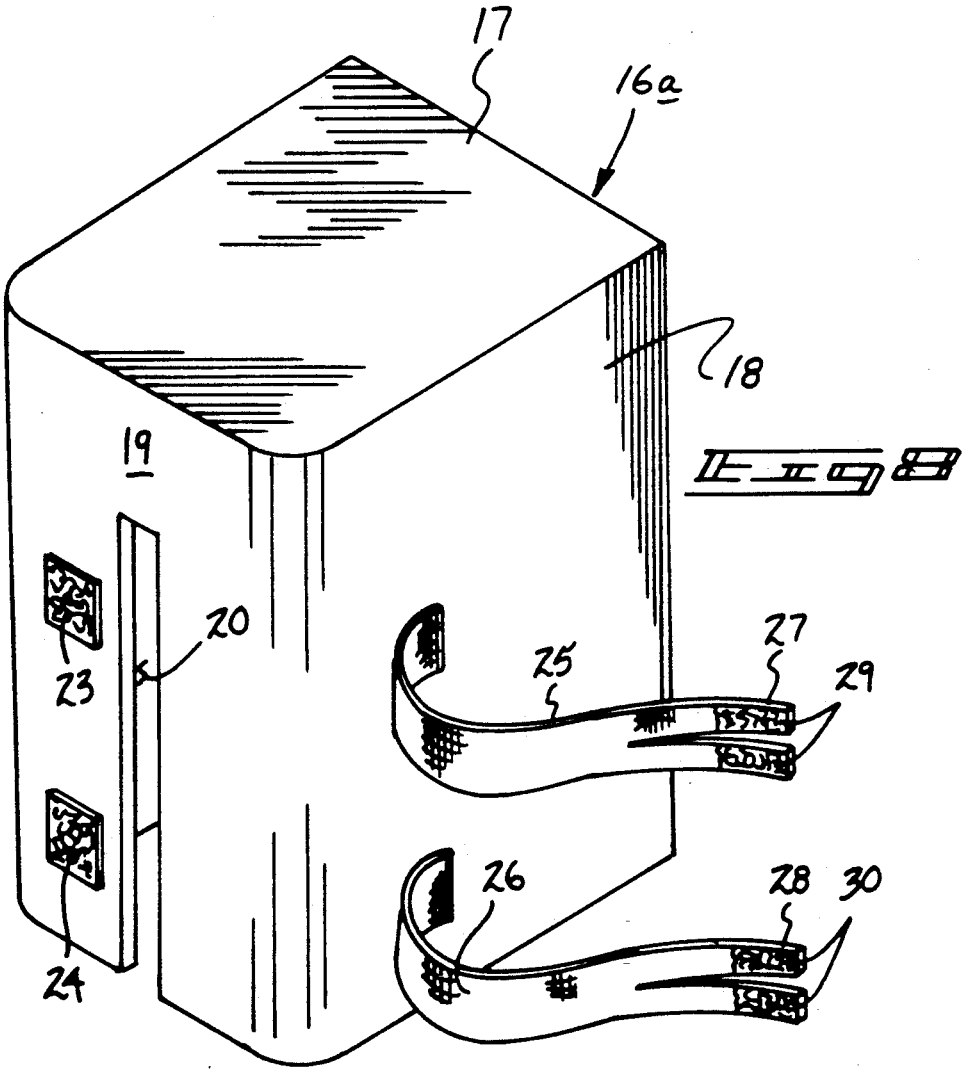
FIG. 8 is an isometric illustration of a modified cover housing utilized by the instant invention.

FIG. 8 illustrates a modified cover housing 16*a* utilizing a first and second fabric fastener patch 23 and 24 respectively at a predetermined spacing equal to a predetermined spacing defined between the plug outlets 12. The first and second fabric fastener patches 23 and 24 cooperate with third and fourth fabric fastener patches 29 and 30 mounted to terminal ends of first and second straps 25 and 26. The terminal ends are defined by respective first and second bifurcated ends 27 and 28 defining a slot therebetween to secure an electrical cord directed between the slot of each bifurcated end 27 and 28 and align the cord relative to each plug outlet 12.

Figure 7A:
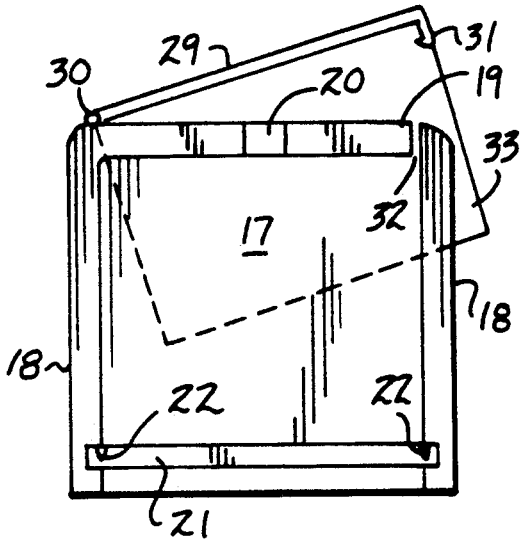
FIG. 7*a* is an orthographic bottom view of a modified covering housing of the instant invention.

FIG. 7A illustrates a further modified cover housing utilizing, in lieu of the flexible first and second straps 25 and 26, rigid legs 29, each including a locking projection 31 receivable within an associated slot 32 formed within the forward wall 19 of the housing. Each of the legs 29 is pivotally mounted about a hinge 30. As illustrated in FIG. 7A, a bottom leg is arranged to include a cover plate 33 to overlie the bottom opening of the housing to fully enclose the housing during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical outlet cover apparatus comprising, in combination, an outlet plate, the outlet plate including a central mounting plate, the mounting plate including a continuous perimeter edge, and a cover housing, the cover housing including securement means for mounting the cover housing to the outlet plate adjacent the perimeter edge, and the mounting plate includes a perimeter flange whose base is fixedly mounted to the mounting plate spaced from and adjacent the perimeter edge, and the perimeter flange angulated outwardly of the mounting plate to overlie the perimeter edge, and the cover housing includes a top wall, spaced side walls, and a forward wall, and the securement means includes a continuous groove directed within the side and top walls directed interiorly of the cover housing, wherein the continuous groove is arranged to receive the perimeter flange, and the forward wall includes a forward wall slot, and the mounting plate includes a plurality of plug outlets, and the forward wall slot is arranged to overlie the plug outlet, and the plug outlets are spaced apart a predetermined spacing, and a first and second fabric fastener mounted to the forward wall adjacent the slot are spaced apart the predetermined spacing, and a first and second strap are mounted to the cover housing, with the first and second strap including a respective first and second bifurcated end, and the first and second bifurcated end includes a respective third and fourth fabric fastener patch securable to the first and second fabric fastener.

* * * * *